US005935192A

United States Patent [19]

Henderson et al.

[11] Patent Number: 5,935,192

[45] Date of Patent: Aug. 10, 1999

[54] SYSTEM AND METHOD FOR REPRESENTING PARAMETERS IN A WORK SITE DATABASE

[75] Inventors: Daniel E. Henderson, Washington; Karl W. Kleimenhagen; Craig L. Koehrsen, both of Peoria; Satish M. Shetty, East Peoria, all of Ill.

[73] Assignee: Caterpillar Inc., Peoria, Ill.

[21] Appl. No.: 08/761,996

[22] Filed: Dec. 12, 1996

[51] Int. Cl.[6] ..... G06F 165/00

[52] U.S. Cl. ..... 701/208; 701/50

[58] Field of Search ..... 701/50, 208, 300, 701/211; 340/995; 707/101, 102, 104

[56] References Cited

U.S. PATENT DOCUMENTS 5,438,771 8/1995 Sahm et al. ..... 37/348
5,471,391 11/1995 Gudat et al. ..... 364/424.07
5,493,494 2/1996 Henderson ..... 364/424.07
5,721,679 2/1998 Monson ..... 364/424.07

*Primary Examiner*—Michael Zanelli
*Attorney, Agent, or Firm*—Kevin M. Kercher

[57] ABSTRACT

The present invention provides a site database structure for storing data for access by an application program being executed on a control system on a work machine. The work machine operates at a work site. The data representing a parameter of the work site. A data structure is stored in the memory. The data structure includes information resident in a database used by the application program. A plurality of data objects are associated with the data structure. Each data object represents a defined section of the work site and is represented by a set of predefined coordinates. At least one layer object is associated with each data object. Each layer object has a predefined number of cell objects. Each cell object has an associated value of the parameter.

16 Claims, 2 Drawing Sheets

SYSTEM AND METHOD FOR REPRESENTING PARAMETERS IN A WORK SITE DATABASE

TECHNICAL FIELD

This invention relates generally to a site database structure and, more particularly, to an apparatus and method for representing parameters of a work site in a database.

BACKGROUND ART

Work machine such as mining shovels and the like are used for excavation work. Much effort has been aimed at automating the work cycle or portions of the work cycle of such machines.

One such system is disclosed in U.S. Pat. No. 5,404,661 issued to William C. Sahm, et al on Apr. 11, 1995. The Sahm system, aimed at a mining shovel, determines the position of a bucket of a work implement as it excavates, i.e., modifies the work site. The position of the bucket as it modifies the work site is used to update a site model or database. The current site model is compared with a desired site model by a differencing algorithm. The output of the differencing algorithm is used to control operation of the work machine or is displayed to the operator to assist in operation.

The work site covers a generally large area. Thus, the database is typically large as well, requiring a resultant large amount of storage space.

There are two general approaches for the structure of the site model. In the first approach, the entire work site is divided into a grid. Each square of the grid represents a fixed point (with fixed X and Y coordinates) in the work site. Data associated with the site is stored at each square. The problem with this approach is that the grid must cover the entire site. Generally, there will be large portions of the site which will not be affected or worked on by the work machine. Thus, large amounts of storage space may be wasted.

In the second approach, only those points required are stored. However, since the grid structure is not used, each of these points requires that the X and Y coordinates of the point be stored as well. This also wastes storage space.

The present invention is directed at overcoming one or more of the problems as set forth above.

DISCLOSURE OF THE INVENTION

In one aspect of the present invention, a memory for storing data for access by an application program being executed on a control system on a work machine is provided. The work machine operates at a work site. The data representing a parameter of the work site. A data structure is stored in the memory. The data structure includes information resident in a database used by the application program. A plurality of data objects are associated with the data structure. Each data object represents a defined section of the work site and is represented by a set of predefined coordinates. At least one layer object is associated with each data object. Each layer object has a predefined number of cell objects. Each cell object has an associated value of the parameter.

In another aspect of the present invention, an apparatus for directing the operation of a working machine on a work site is provided. A position sensing system, located on the working machine, is adapted to sense the position of at least one fixed point located on the working machine as the working machine traverses the work site. A controller contains a database containing data representing a parameter of the work site. The data is contained in a data structure. The data structure contains a plurality of data objects associated with the data structure. Each data object represents a defined section of the work site and is represented by a set of predefined coordinates and at least one layer object. Each layer object has a predefined number of cell objects. Each cell object has an associated value of the parameter. The apparatus accesses the database and responsively directs operation of the working machine.

In still another aspect of the present invention, a method for storing data for access by an application program being executed on a control system on a work machine, is provided. The work machine operates at a work site. The data represents a parameter of the work site. The method includes the steps of dividing the work site into a plurality of defined sections. Each defined section has predetermined dimensions. The method also includes the step of assigning a data object to each defined section. Each data object includes a set of predefined coordinates. The set of predefined coordinates represents a corresponding defined section. The method further includes the step of associating each data object with at least one layer object. Each layer object has a predefined number of cell objects. Each cell object has an associated value of the parameter.

BEST MODE FOR CARRYING OUT THE INVENTION

Figure 1:
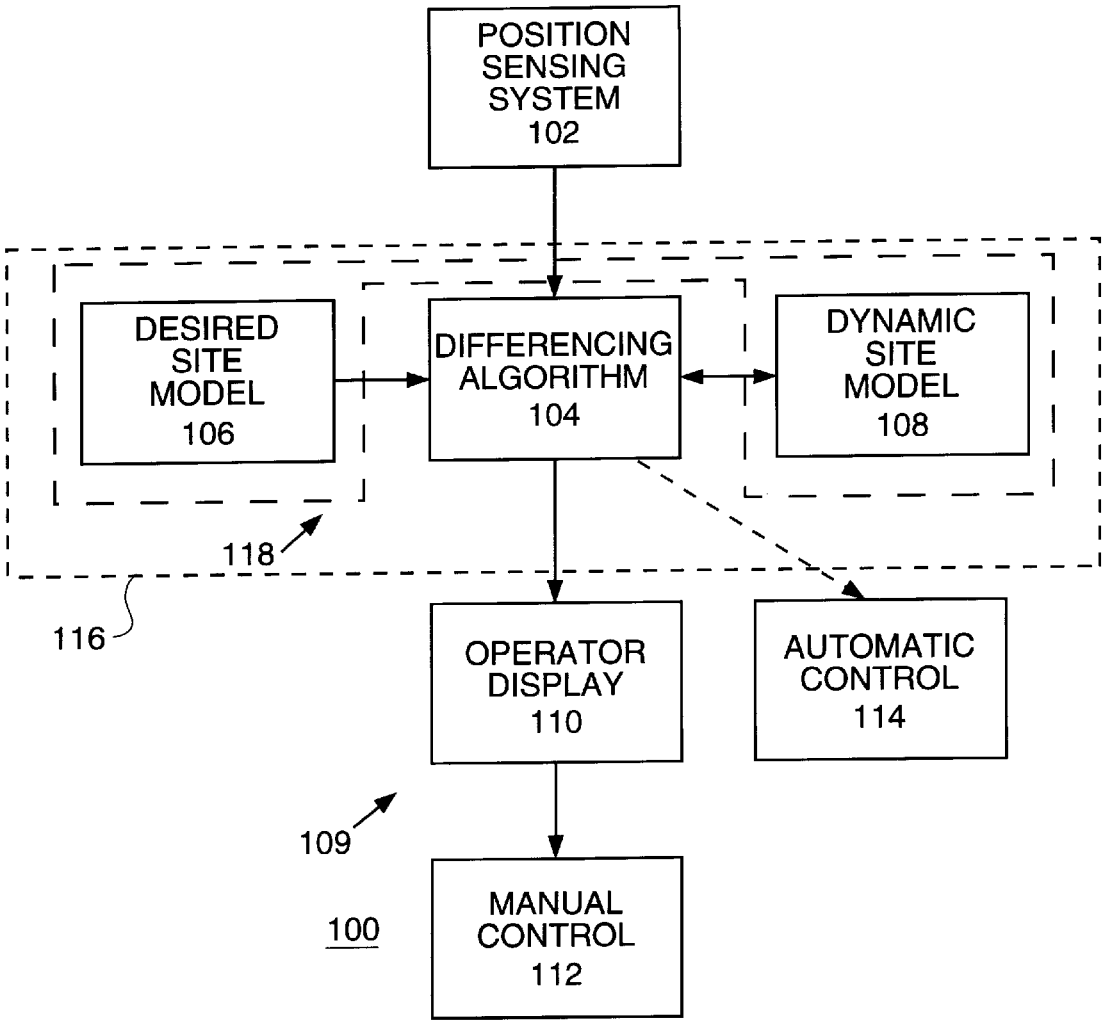
FIG. 1 is block diagram of an apparatus for implementing the present invention, according to one embodiment; and, FIG. 2 is a diagrammatic representation of a database structure for representing and storing parameter values associated with a work site, according to an embodiment of the present invention.
Figure 2:
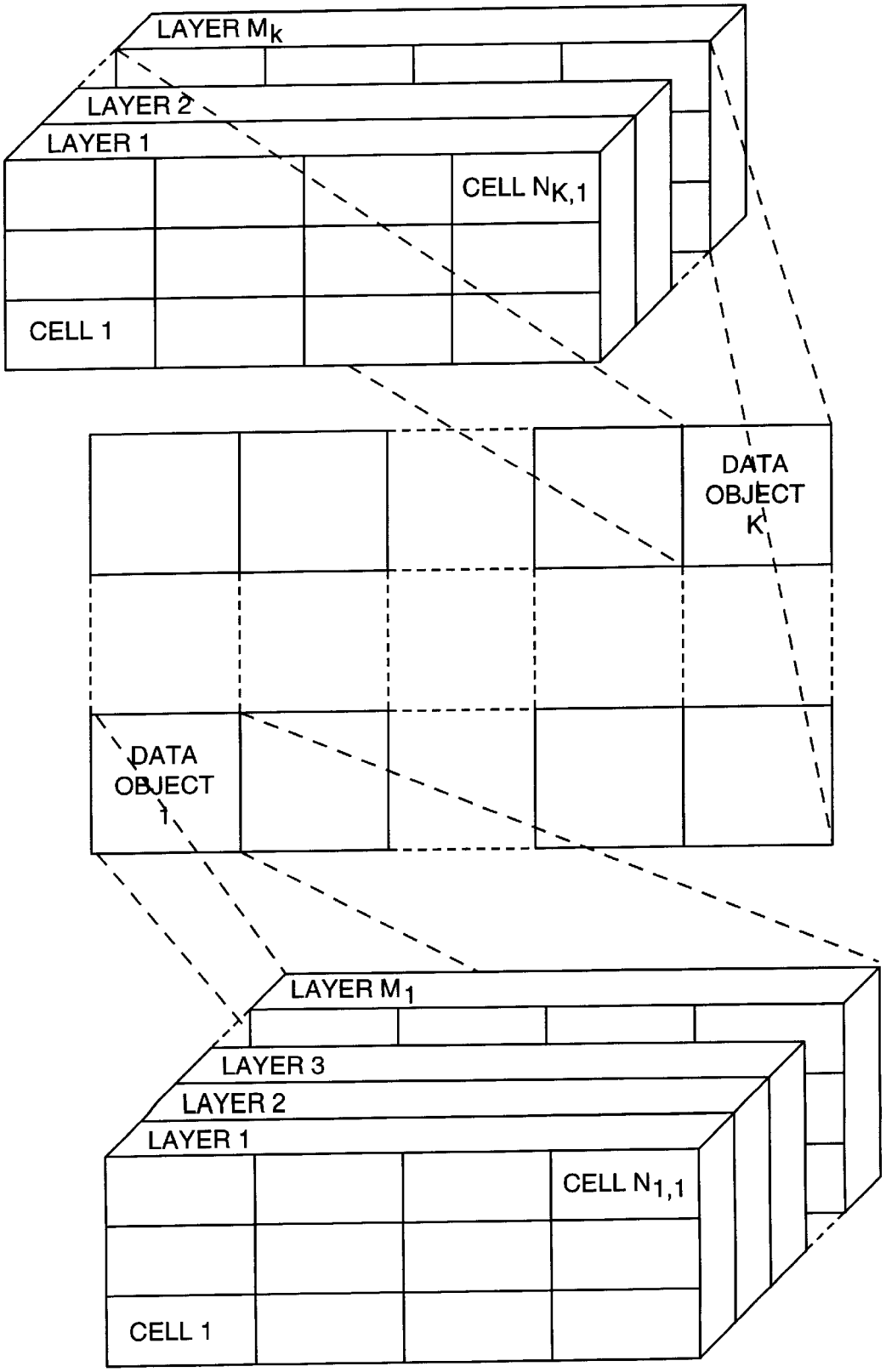

With reference to FIGS. 1–2, the present invention provides an apparatus, method, and database structure for representing a work site 202 in a site database 204.

In the preferred embodiment, the present invention 100 is used in conjunction with a mobile earthmoving or work machine (not shown) such as a track-type tractor or dozer, a profiler, a motorgrader, a scraper, a road reclaimer, a wheel loader and the like.

A position sensing system 102 determines the position of a point located on the mobile machine. The point may be located on the body of the machine or on a work implement (not shown) of the mobile machine. As discussed below, the position of at least one reference point located on the machine is used to dynamically update the site database 204.

In the preferred embodiment, the position sensing system 102 includes a three-dimensional positioning system with an external reference, for example, (but not limited to) 3-D laser, Global Positioning Systems (GPS), GPS/laser combinations, radio triangulation, microwave, or radar. Position coordinates of the reference point are determined as the mobile machine operates within the work site 202.

A micro-processor based controller 116 is coupled to the position sensing system 102. The controller 116 receives the position coordinates from the position sensing system 102 and updates a dynamic site model 108. The controller 116 may also perform other functions as described below.

The position coordinates are supplied as a series of discrete points to a differencing algorithm 104. The controller 116 includes storage memory 118 for storing a desired site model 106 and a dynamic site model 108. The desired site model 106 and the dynamic site model 108 each includes a site database. Preferably, the desire site database and the dynamic site database store data representing site elevations(desired elevation and current elevation, respectively). However, the site databases may additionally store values of other parameters of the work site, e.g., material or ore type, previous elevation, number of passes by the work machine.

The site databases may also include information related to a compaction level. For a compactor, site specifications may require a specific number of passes of the machine over a given area dependent upon the material type and a change in the elevation. The compaction level relates to the number of passes remaining for a change in the elevation The differencing algorithm 104 is implemented in software on the controller 116 and calculates the difference between the desired and dynamic site models.

The differencing algorithm 104 is coupled to a directing means 109. The directing means 109 accesses the databases and responsively directs operation of the working machine. The direction means 109 preferably includes an operator display 110. The operator display 110 includes a graphical representation of the work site illustrating the stored values of the parameter(s). The operator display 110 is used to assist the operator in manual control 112 of the work machine. Optionally, the direction means 109 may include an automatic control 114 for autonomously controlling operation of the work machine in response to the data stored in the databases.

The site models are preferably stored in a memory 118. The memory may be any suitable memory structure for storing data, including, but not limited to random access memory, programmable read only memory, fixed disk drives, removable disk drives, and the like.

With reference to FIG. 2, the memory 118 stores data for access by an application program being executed on the controller 116. The memory stores data in a data structure 202. The data structure 202 includes information resident in the databases used by the application program.

The data structure includes a plurality of data objects (data object 1–data object K) associated with the data structure. Each data object represents a defined section of the work site and is represented by a set of predefined coordinates.

At least one layer object is associated with each data object. Each layer object has a predefined number of cell objects. Each cell object has an associated value of at least one parameter.

For example in the data structure of FIG. 2, the work site is divided into K defined sections represented by data objects 1–K. Data object 1 includes $M_1$ layer objects. Layer 1 of data object 1 includes $N_{1,1}$ cell objects. Layer $M_1$ of data object 1 has $N_{1,M1}$ cell objects.

In a similar manner, data object K includes $M_K$ layer objects. Layer 1 of data object K includes $N_{K,1}$ cell objects. Layer $M_K$ of data object K includes $N_{K,MK}$ cell objects.

Preferably, each layer of the data objects includes data values of different parameters.

Advantageously, only data objects representing a defined section of the work site which is required by the working machine is stored in the memory 109.

In one embodiment, each data object has one or more layers. Stored in the cells on each layer are values of a single parameter.

In another embodiment, the data structure is divided into two or more data sub-structures. Each data sub-structure is divided into a plurality of data objects. The data objects of one sub-structure may or may not be the same size as the data objects of another sub-structure.

INDUSTRIAL APPLICABILITY

With reference to the drawings and operation, the present invention provides an apparatus, a memory, and a method for storing data for access by an application program being executed on the controller on the work machine. The data represents a parameter of the work site.

The present invention divides the work site into a plurality of defined sections. Each defined section is defined by predetermined dimensions and a set of coordinates.

Each data object includes at least one layer object. A layer object is typically associated with one parameter of the work site. Each layer object is divided into a predetermined number of cells. The cells have a predetermined dimension.

Each cell stores a value of the associated parameter for a predetermined point or section of the work site. Each cell within a layer has a known location within the layer. Thus, the value of the parameter for any point on the work site can be determined.

Each data object has one associated, stored set of coordinates, typically representing one of the corners of the corresponding defined section of the work site. Each layer within the data object is divided into regular cells. The corresponding location in the work site of a cell can be determined from known offsets of the cell from the stored set of coordinates of the data objects.

Furthermore, only data objects which represent required defined sections of the work site need be stored.

In this manner, coordinates for each cell need not be stored. Additionally, only the relevant portions of the work site need be represented. Thus, the work site can be efficiently represented in the data structure with sufficient resolution.

Other aspects, objects, and features of the present invention can be obtained from a study of the drawings, the disclosure, and the appended claims.

We claim:

1. An apparatus for directing the operation of a working machine on a work site, comprising:

a position sensing system adapted to sense the position of at least one fixed point located on the working machine as the working machine traverses the work site and responsively producing a position signal;

a controller, adapted to receive the position signal, the controller containing a database containing data representing a parameter of the work site, the data contained in a data structure, the data structure containing a plurality of data objects associated with the data structure, each data object representing a defined section of the work site and represented by a set of predefined coordinates and at least one layer object, each layer object having a predefined number or cell objects, each cell object having an associated value of the parameter and defined by a set of coordinates derived from said set of predefined coordinates; and directing means, coupled to the controller, for accessing the database and responsively directing operation of the working machine.

2. An apparatus, as set forth in claim 1, wherein the directing means includes an operator display.

3. An apparatus, as set forth in claim 1, wherein the directing means includes an automatic control.

4. An apparatus, as set forth in claim 1, wherein only data objects representing a defined section of the work site which is required by the working machine is stored in the memory.

5. A method for storing data for access by an application program being executed on a control system on a work machine, the work machine operating at a work site, the data representing a parameter of the work site, including the steps of:

dividing the work site into a plurality of defined sections, each defined section having predetermined dimensions;

assigning a data object to each defined section, each data object including a set of predefined coordinates, the set of predefined coordinates representing a corresponding defined section;

associating each data object with at least one layer object, each layer object having a predefined number of cell objects, each cell object having an associated value of the parameter; and deriving a coordinate of each of said cell objects from its data object's set of predefined coordinates.

6. A memory for storing data for access by an application program being executed on a control system on a work machine, the work machine operating at a work site, the data representing a parameter of the work site, comprising:

a data structure stored in the memory, the data structure including information resident in a database used by the application program;

a plurality of data objects, associated with the data structure, each data object representing a defined section of the work site and represented by a first set of predefined coordinates; and at least one layer object associated with each data object, each layer object having a predefined number of cell objects, each cell object having an associated value of the parameter and represented by a second set of coordinates derived from said first set of predefined coordinates.

7. A memory, as set forth in claim 6, wherein the data represents a second parameter, at least one layer object including a predefined number of cell objects having associated values of the second parameter.

8. A memory, as set forth in claim 6, including first and second data objects, the first data object having $M_1$ layers, the second data object having $M_2$ layers.

9. A memory, as set forth in claim 6, wherein the parameter is elevation.

10. A memory, as set forth in claim 6, wherein the parameter is a number representative of material type.

11. A memory, as set forth in claim 6, wherein the parameter is actual elevation.

12. A memory, as set forth in claim 6, wherein the parameter is desired elevation.

13. A memory, as set forth in claim 6, wherein the parameter is a past elevation.

14. A memory, as set forth in claim 6, wherein the parameter is a number of passes.

15. A memory, as set forth in claim 6, wherein the parameter is a compaction level.

16. A memory, as set forth in claim 6, wherein only data objects representing a defined section of the work site which is required by the working machine is stored in memory.

* * * * *

UNITED STATES PATENT AND TRADEMARK OFFICE
CERTIFICATE OF CORRECTION

PATENT NO : 5,935,192

DATED : Aug. 10, 1999

INVENTOR(S): Henderson et al.

It is certified that error appears in the above-identified patent and that said Letters Patent is hereby corrected as shown below:

Please amend Patent No. 5,935,192 at Column 1, line 4 by adding the following new paragraph:

--The invention described herein was made in the performance of work under NASA Cooperative Agreement No. NCC2-9007, Contract No. TRP SOL93-29 and is subject to the provisions of Section 305 of the National Aeronautics and Space Act of 1958 (42 U.S.C. 2457). The Government has certain rights to this invention.--

Signed and Sealed this

Thirty-first Day of October, 2000

*Attest:*

*Attesting Officer*

Q. TODD DICKINSON

*Director of Patents and Trademarks*